US006569010B1

(12) United States Patent
Miller et al.

(10) Patent No.: US 6,569,010 B1
(45) Date of Patent: May 27, 2003

(54) INDUCED AIR DISTRIBUTION SYSTEM

(75) Inventors: James H. Miller, Camillus, NY (US); William R. Shultes, Clay, NY (US)

(73) Assignee: NuClimate Air Quality Systems, Inc., E. Syracuse, NY (US)

( * ) Notice: Subject to any disclaimer, the term of this patent is extended or adjusted under 35 U.S.C. 154(b) by 0 days.

(21) Appl. No.: 10/132,560

(22) Filed: Apr. 25, 2002

(51) Int. Cl.[7] ..... F24F 1/00
(52) U.S. Cl. ..... 454/236; 454/233
(58) Field of Search ..... 454/263, 233, 454/338, 236

(56) References Cited

U.S. PATENT DOCUMENTS 5,577,958 A * 11/1996 Kumekawa et al. ..... 454/233
6,089,972 A * 7/2000 Gunji et al. ..... 454/233
6,213,867 B1 4/2001 Yazici et al.
6,250,373 B1 * 6/2001 Vecchi et al. ..... 165/125
6,370,907 B1 * 4/2002 Sekiguchi et al. ..... 454/233

* cited by examiner

*Primary Examiner*—Harold Joyce
*Assistant Examiner*—Derek Boles
(74) *Attorney, Agent, or Firm*—George R. McGuire; Hancock & Estabrook, LLP

(57) ABSTRACT

The present invention provides an air handling system that receives air from a primary air source and distributes that air in a room defining an enclosed space. The system is mounted in the ceiling of the room and generally comprises first, second, third, and fourth inductor units interconnected downstream to the primary air supply and which define first, second, third, and fourth areas, respectively, wherein the induced air flows through each of the inductor units, through a series of converging nozzles, and into each units first, second, third, and fourth areas, respectively, and an air diffusing mechanism positioned adjacent to the first, second, third, and fourth areas which directs the induced air in first, second, third, and fourth directions, respectively. The inductors are generally arranged in a square configuration with the diffuser extending in the square space bound thereby.

14 Claims, 9 Drawing Sheets

200
208
210
202
204
206

200
216
210
212
208
202
204
218
214
206

200
216
206

200
216
212
204

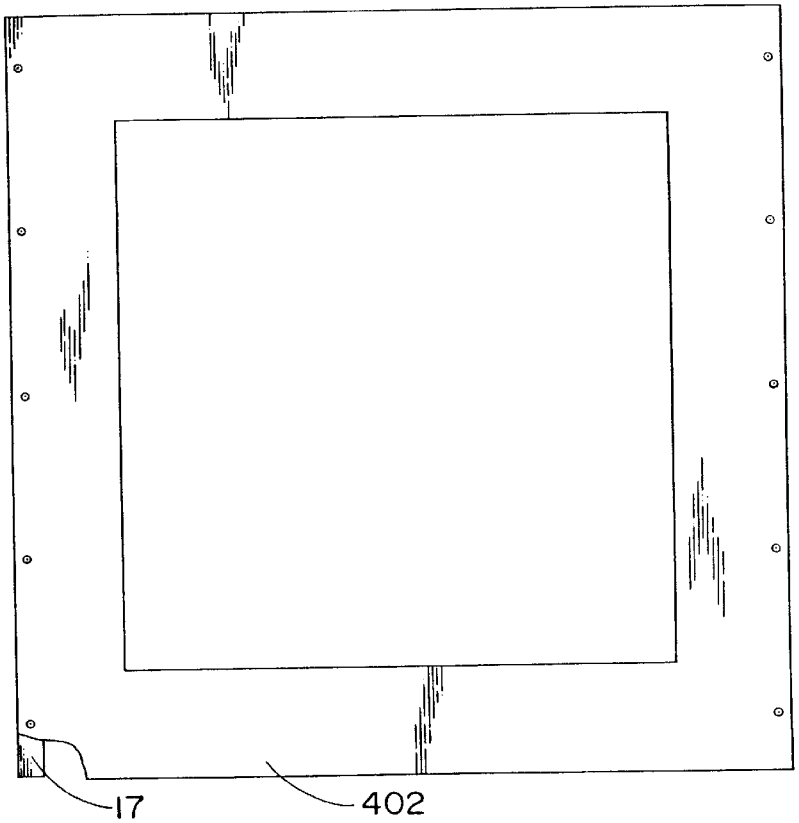
FIG. 13
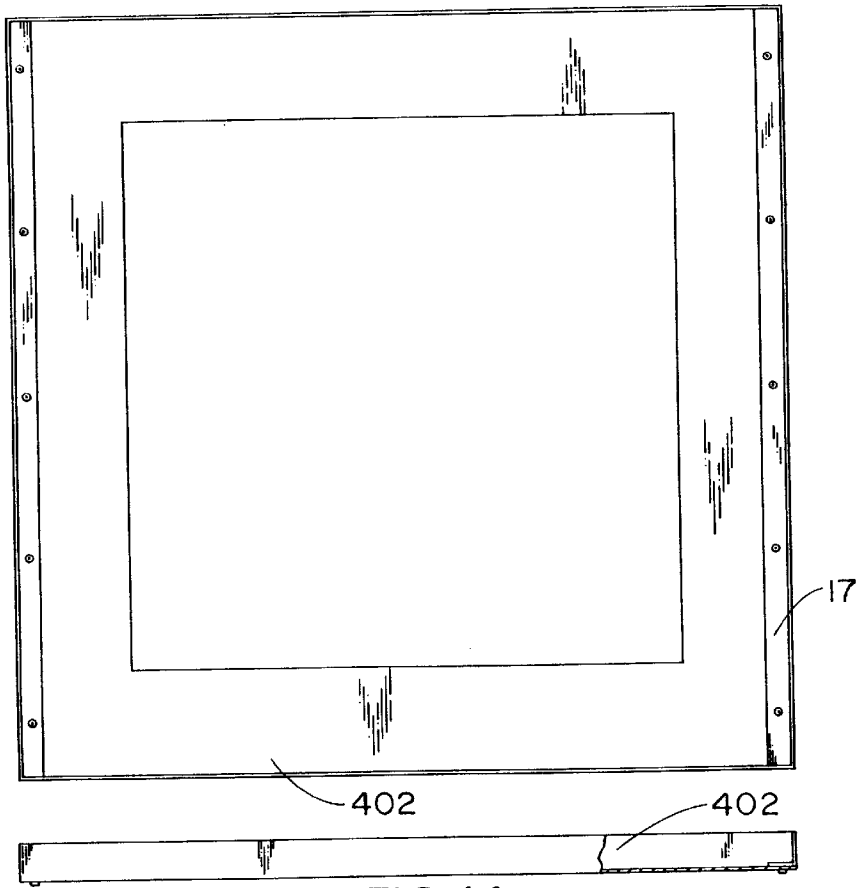
FIG. 12
FIG. 14

INDUCED AIR DISTRIBUTION SYSTEM

BACKGROUND OF THE INVENTION

1. Field of Invention

The present invention relates generally to air handling and distributing devices, and more particularly to such devices of the inductive type that distribute air in an enclosed space in a Coanda or Venturi type flow pattern.

2. Description of Prior Art

Traditional induction systems generally comprise one or two inductors that diffuse air into an enclosed room and distribute the air arbitrarily throughout the room. The air flow pattern generally causes the air to rise and recycle back through the inductors. The source of the air can be an externally positioned air conditioning unit that directs the conditioned air through a piping arrangement and into the inductor units. The inductors then cause the received air to pass through a series of nozzles (generally converging nozzles so as to accelerate the air flow), and out of the indicator and into the room through a diffuser. The air circulates around the room and is recycled back through the and into the induction unit where it passes over a series of cooling/heating tubes. After passing over the heating/cooling tubes, the recycled air is combined/mixed with the conditioned air passing out through the nozzles and is pushed back into the room. While such a system is operable, it produces an inefficient and inconsistent air flow in the room.

3. Objects and Advantages

It is therefore a principal object and advantage of the present invention to provide an induced air handling and distributing system that produces an efficient and consistent air flow in a room.

It is another object and advantage of the present invention to provide an air handling and distributing system that can be retrofit into existing spaces, and replace prior art type systems.

Other objects and advantages of the present invention will in part be obvious, and in part appear hereinafter.

SUMMARY OF THE INVENTION

In accordance with the foregoing objects and advantages, the present invention provides an air handling system that receives air from a primary air source and distributes that air in a room defining an enclosed space. The system is mounted in the ceiling of the room and generally comprises first, second, third, and fourth inductor units interconnected downstream to the primary air supply and which define first, second, third, and fourth areas, respectively, wherein the induced air flows through each of the inductor units, through a series of converging nozzles, and into each units first, second, third, and fourth areas, respectively, and an air diffusing mechanism positioned adjacent to the first, second, third, and fourth areas which directs the induced air in first, second, third, and fourth directions, respectively. The inductors are generally arranged in a square configuration with the diffuser extending in the square space bound thereby. Louvers mounted about the periphery of the diffuser and positioned in spaced relation below the open areas direct the air flow emitted from the inductor units at predetermined outward angles. As the air flowing through each of the four inductors is roughly equal to one another, the air handling system generally distributes an equal flow of air in every direction throughout the room.

The air flow pattern initially extends in a horizontal path along the ceiling and away from the unit. The path then transitions to a vertically downward direction, until the floor forces the air to circulate upwards and in a direction towards the unit. A small portion of the air may pass by a temperature/humidity (or other air condition) sensor and be redirected to an externally mounted air conditioning unit (which is the primary air source for the air handling system, and which based on the re-circulated and sensed air, can then readjust its conditioning elements to maintain the primary air flow at predetermined temperature/humidity/other air condition levels). The remainder of the air will pass upwards through the diffuser and back into the inductor units. Once in the inductor units, the air passes over a series of heating/cooling tubes, and into the open areas below the nozzles. The re-circulated air is then mixed with the accelerated air flow coming through the nozzles and directed back into the room.

BRIEF DESCRIPTION OF THE DRAWINGS

The present invention will be more fully understood and appreciated by reading the following Detailed Description in conjunction with the accompanying drawings, in which:

FIG. 12 is a top plan view of a ceiling panel assembly;

FIG. 13 is a bottom plan view thereof;

FIG. 14 is a side elevation view thereof;

DETAILED DESCRIPTION

Figure 1:
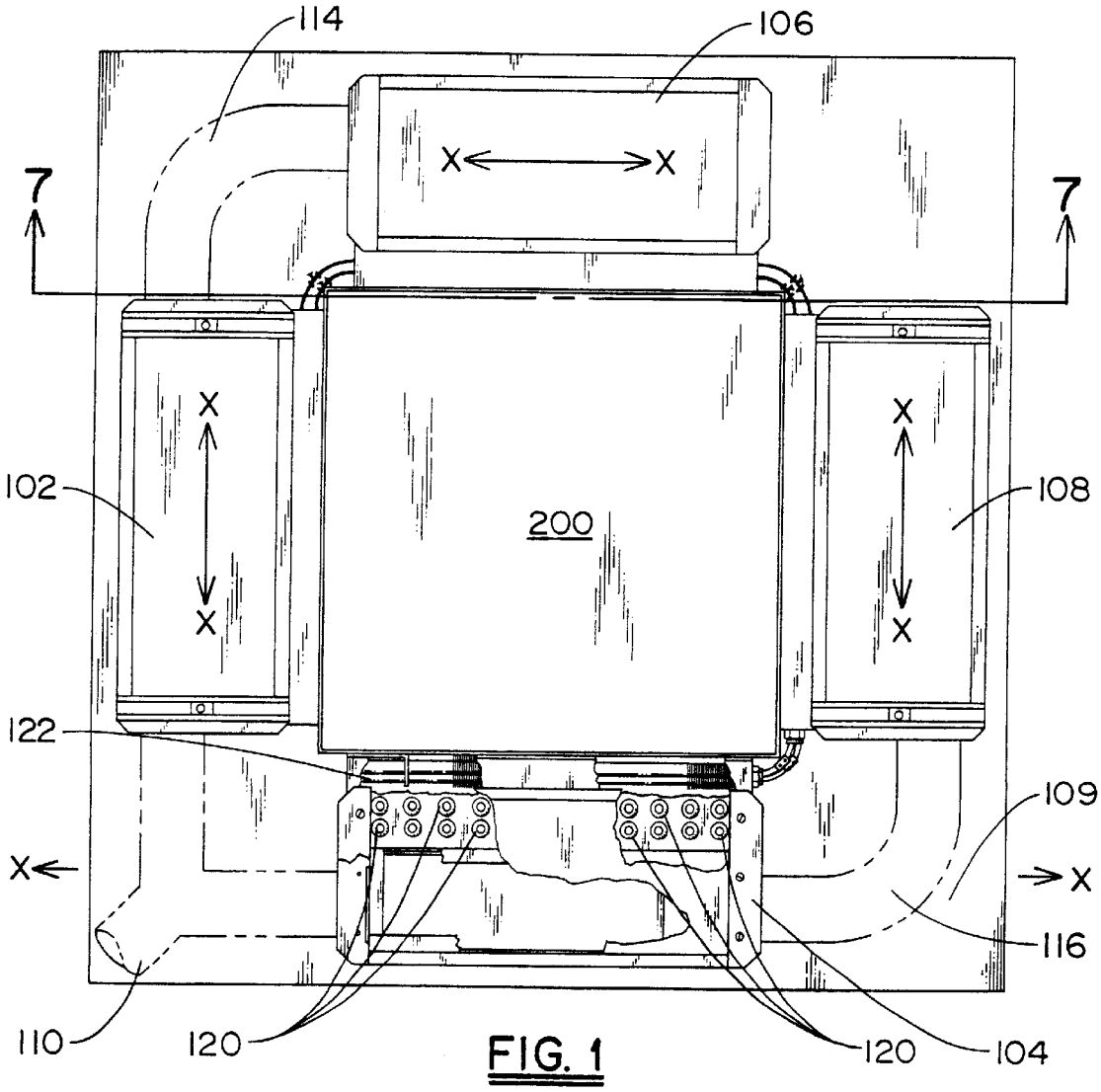
FIG. 1 is a top plan view of the present invention in its assembled state.

Referring now to the drawings, in which like reference numerals refer to like parts throughout, there is seen an air handling system, designated generally by reference numeral 10, for mounting above and through the ceiling of an enclosed room 12. Air handling system 10 is generally comprised of three subassemblies: an inductor assembly 100, a diffuser assembly 200, and a diffuser frame assembly 300 (although the diffuser assembly 200 and diffuser frame assembly 300 could be manufactured as a single assembly).

Briefly, and as described in more detail below, a primary air conditioning source 14 sends primary air through conduit 16 to inductor assembly 100. In turn, inductor assembly 100 discharges the primary air through an angled channel defined between diffuser assembly 200 and diffuser frame assembly 300. The discharged air is evenly distributed in room 12, and a minority portion of the distributed air is recycled back to primary air source 14, while a majority portion of the air is recycled back through diffuser assembly 200 and into inductor assembly 100 where it is mixed with the primary air and discharged back into room 12.

Figure 2:
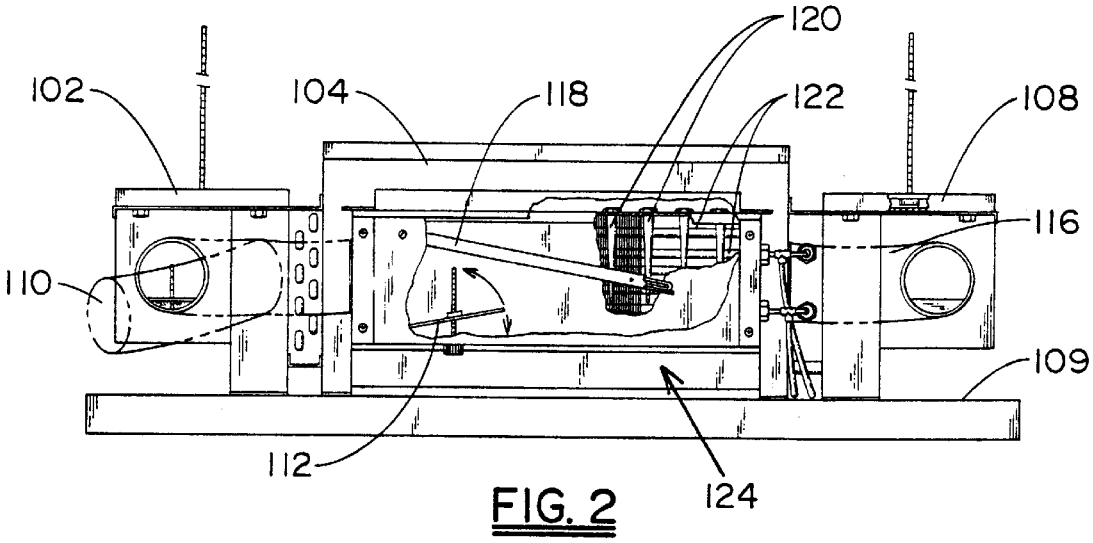
FIG. 2 is a side elevation view of the present invention.

Referring to FIGS. 1–2, inductor assembly 100 comprises first, second, third, and fourth inductor units 102, 104, 106, and 108, respectively, all of which are mounted on an inductor frame 109. First and second inductor units 102, 104 initially receive the primary, conditioned air from primary air source 14 through a Y-shaped coupling 110 which essentially evenly splits the flow of primary air between the two inductor units. A portion of the air entering inductor units 102, 104 is directed via air flow lever 112 (see FIG. 2) through conduits 114, 116 and into third and fourth inductor units 106, 108, respectively, while a portion of the primary air is directed via baffling 118 (see FIG. 2) into a series of nozzles (preferably converging nozzles—see FIG. 1) 120. Lever 112 and baffling 118 operate to virtually equally split the flow of air between the two inductor units 102, 106 and 104, 108, respectively. As each of inductor units 102–108 are substantially identical, when explaining the structure of an inductor, reference will be made to only one, it being understood that each inductor unit contains the same internal structure and components. In addition, as inductor units 102–108 are only slightly modified, commercially available units, only their critical elements will be explained in any detail, the remainder of their structures being well known to those skilled in the art. An example of a commercially available inductor unit that could be employed in the present system is the ML48 inductor unit, distributed by M&I Heat Transfer Products, Ltd. of Mississauga, Ontario, Canada.

Figure 16:
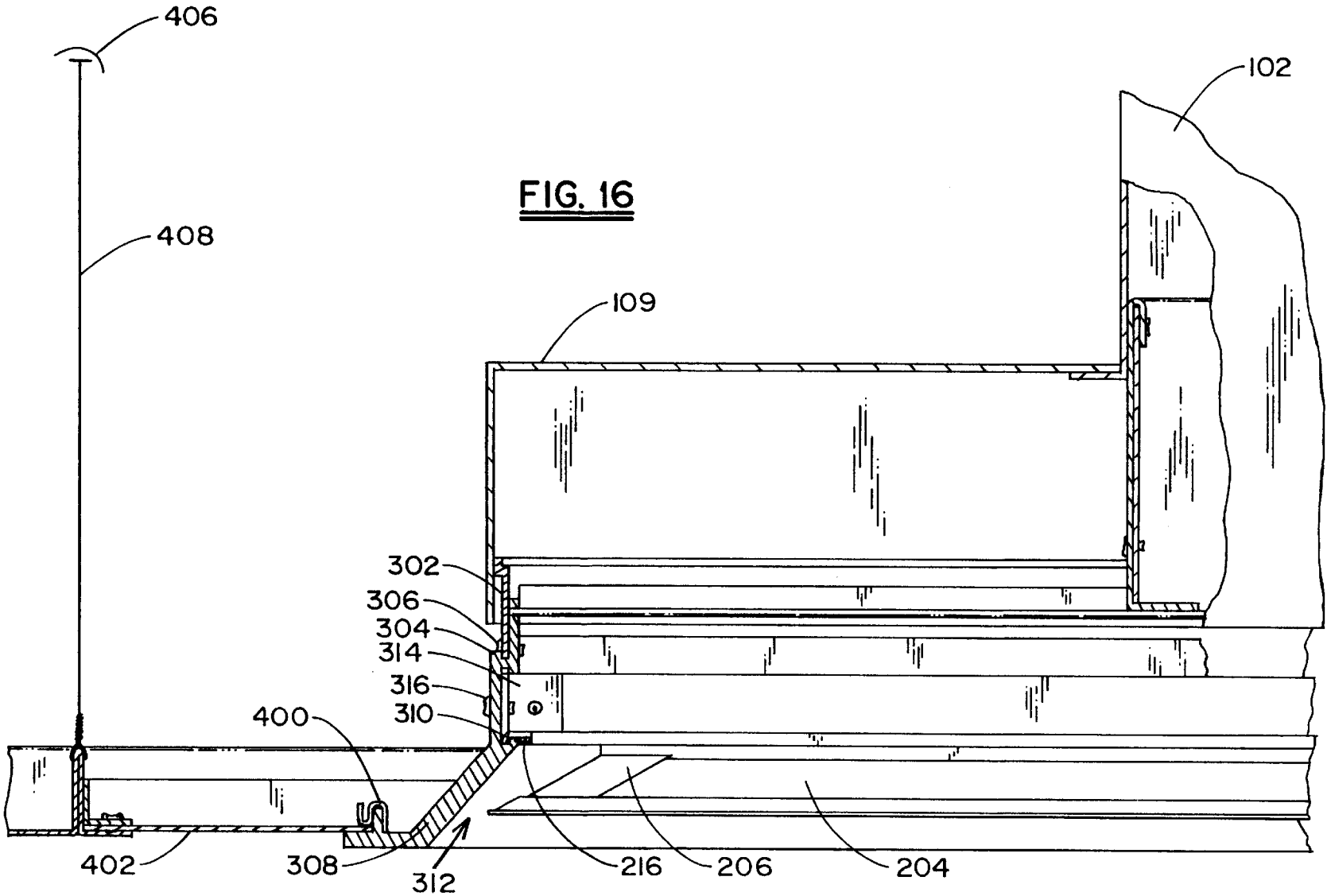
FIG. 16 is a partial cross-section view of the unit in its assembled and mounted state.
Figure 17:
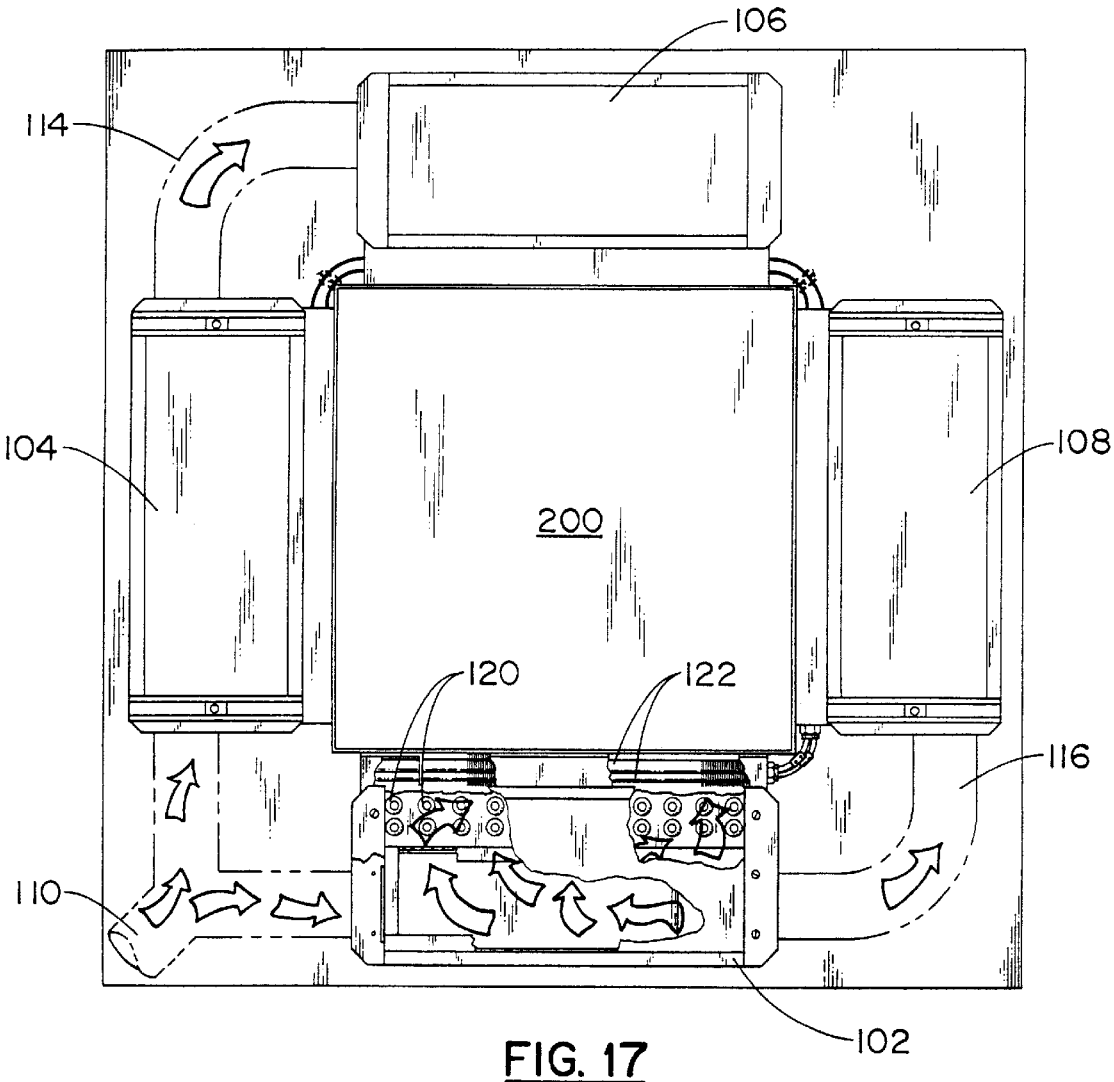
FIG. 17 is a top plan view of the present invention with portions broken away to illustrate the primary air flow direction.

Once the primary air enters inductor units 102–108, it is forced through nozzles 120 present in each of the inductor units, and discharged in the space defined between diffuser assembly 200 and diffuser frame assembly 300, as will be explained in greater detail hereinafter. Inductor units 102–108 each extend along respective longitudinal axes X—X with the axis of unit 102 intersecting the axes of units 104 and 106 at essentially right angles, and extending parallel to the axis of unit 1 08, thereby defining a rectangular arrangement (because the units 102–108 are of equal size and are interconnected with equal size conduits 114, 116, the arrangement is actually square). As a consequence of this arrangement, the air that is discharged from inductor assembly 100 and through diffuser assembly 200 and diffuser frame assembly 300, into room 12 distributes itself in equal amounts and in every direction (360 degrees) surrounding air handling system 10, thereby providing an even distribution of air in room 12, as illustrated by the air flow arrows in FIG. 16.

Once the primary air is discharged into room 12, due to the orientation of diffuser assembly 200 and diffuser frame assembly 300 it follows an outwardly directed curved path, as will be explained in greater detail hereinafter, due to what is referred to in the air handling industry as the Coanda effect (in aerodynamics, the Coanda effect refers to the curved path a fluid follows due to a curved object being placed in its path), and what may also be referred to as the Venturi effect. The air flow path initially extends along the ceiling of room 12, eventually being forced downwardly and inwardly by a wall (or counter directed air flow coming from a second air handling system that may also be present in room 12—the number of air handling systems installed in a given room is obviously a function of the size of the room and the volume flow rate of the air forced through the system), and eventually back into an upwardly and inwardly directed flow pattern due to the floor in room 12. The upwardly directed air eventually passes through diffuser assembly 200 and is induced over a series of heating/cooling tubes 122 present in inductor units 102–108 (heating/cooling tubes 122 are standard tubes which have water or other liquid flowing continuously there through, and which can be controlled to heat or cool the secondary air as desired). After passing over heating/cooling tubes 122, the secondary (recycled) air is forced into a plenum area 124 present in each inductor unit 102–108 and positioned directly beneath nozzles 120, where it is mixed with the primary air being expelled from nozzles 120. The mixed primary and secondary air is then discharged into room 12 in the same manner as the initial discharge of the primary air explained above, and the process continues until such time as air handling system 10 is turned off.

Referring to FIGS. 8–11, diffuser assembly 200 comprises a diffuser plate 202 that consists of a square (or other shape that conforms to the geometry of diffuser assembly 100) grid of openings through which the secondary air passes, and four sets of outwardly flared louvers 204, 206, 208, 210 extending along each peripheral edge of plate 202 in such an angle to discharge the air in an horizontal direction across the ceiling (e.g., 45 degrees). A pair of channels 212, 214 each having a series of spring loaded clips 216, 218 extend along opposing sides of the upper surface of diffuser plate 202. Spring loaded clips 216, 218 engage respective ridges formed in outer diffuser assembly 300, as will be explained hereinafter, thereby interconnecting the two sub-assemblies.

Figure 4:
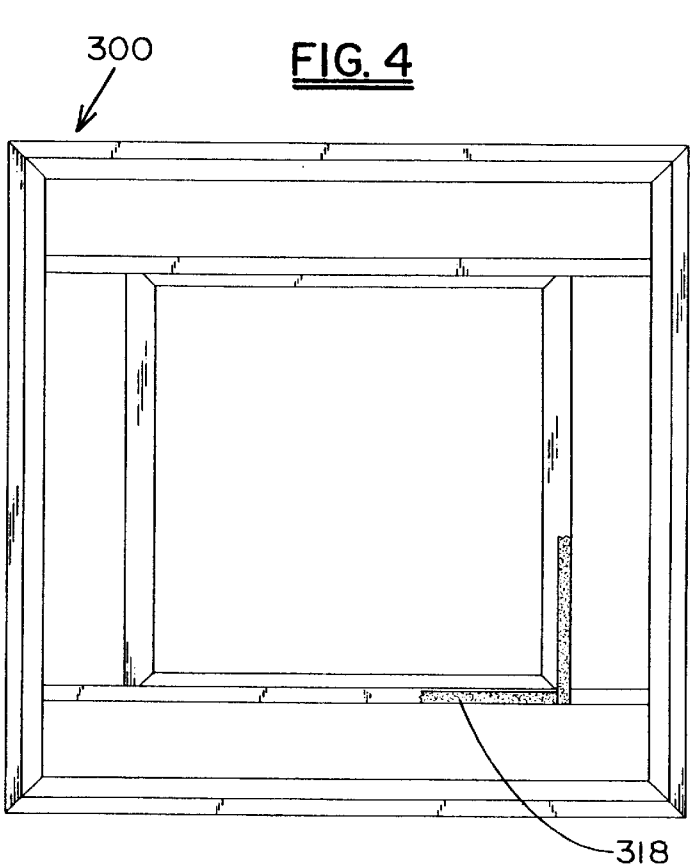
FIG. 4 is a bottom plan view thereof.
Figure 3:
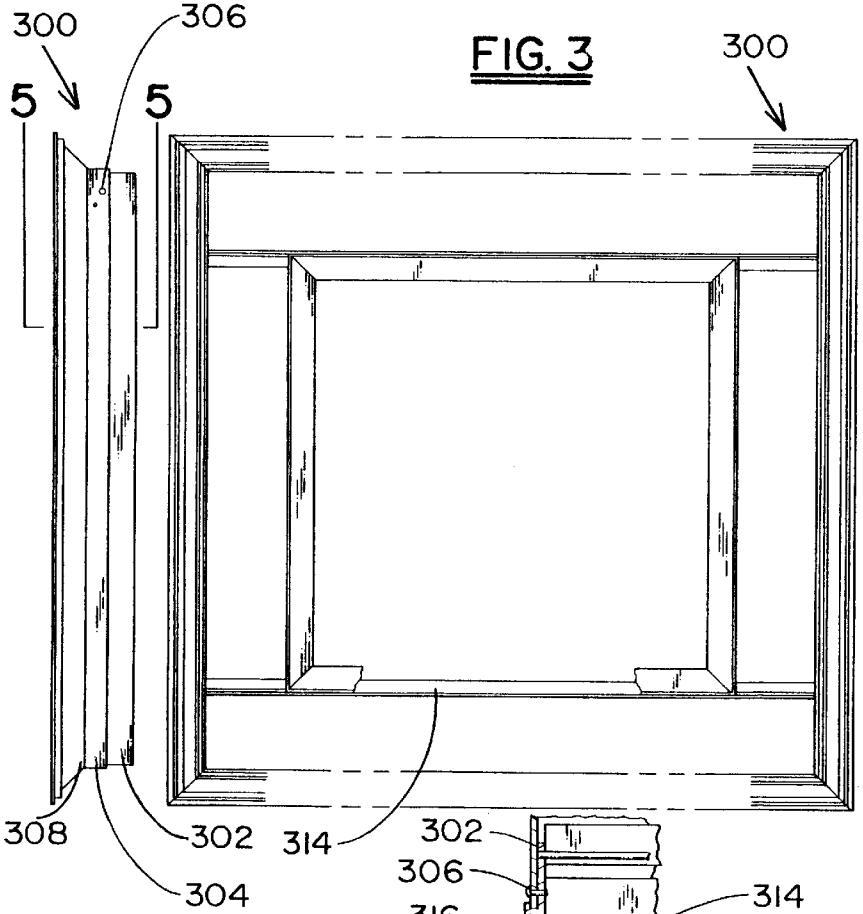
FIG. 3 is a top plan view of the outer diffusion frame assembly.
Figure 5:
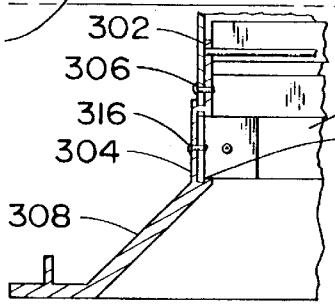
FIG. 5 is a cross-section view taken along section line 5—5 of FIG. 3.
Figure 6:
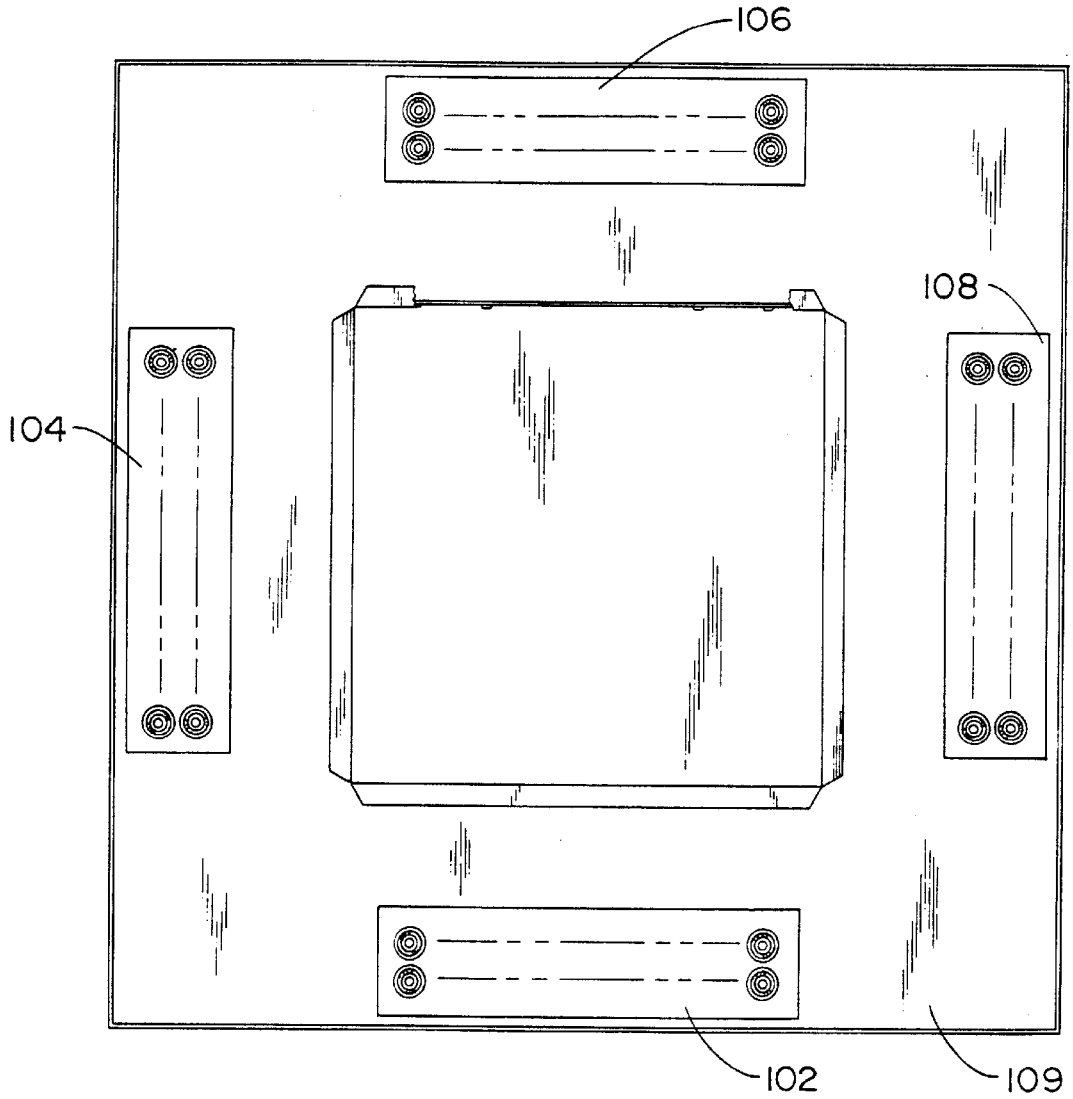
FIG. 6 is a bottom plan view of the assembled unit.
Figure 7:
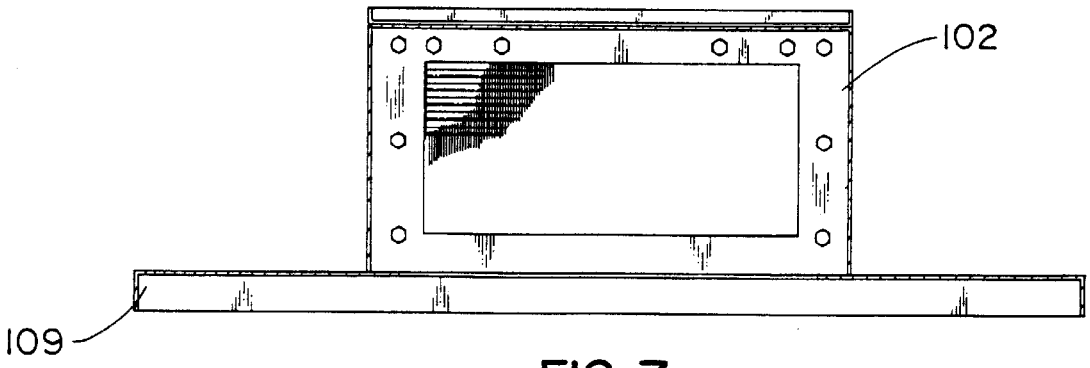
FIG. 7 is a cross-section view taken along section line 7—7 of FIG. 1.
Figures 8, 9, 10, 11:
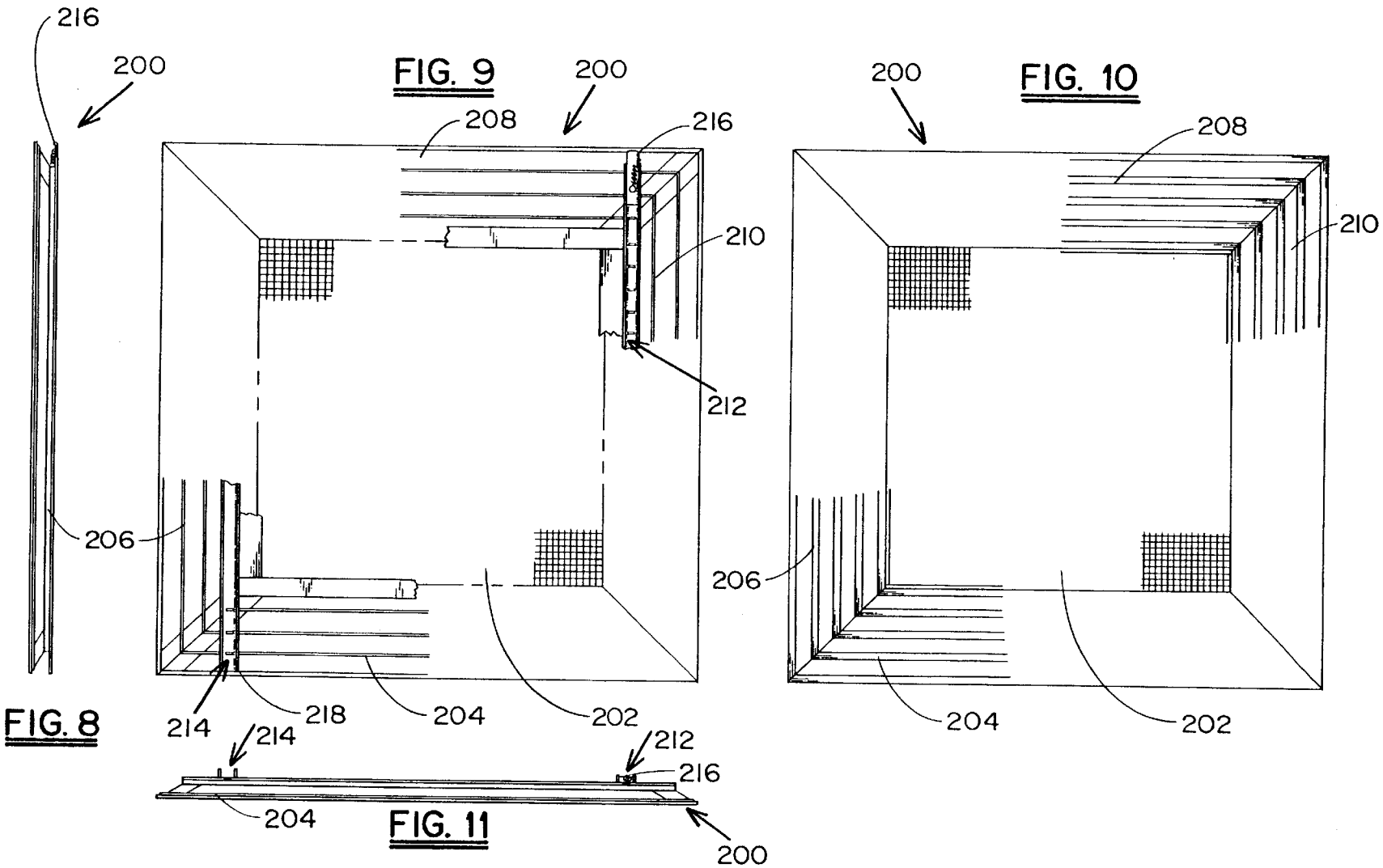
FIG. 8 is a side elevation view of the inner diffusion frame assembly.
FIG. 9 is a top plan view thereof.
FIG. 10 is a bottom plan view thereof.
FIG. 11 is another side elevation view thereof.
Figure 15:
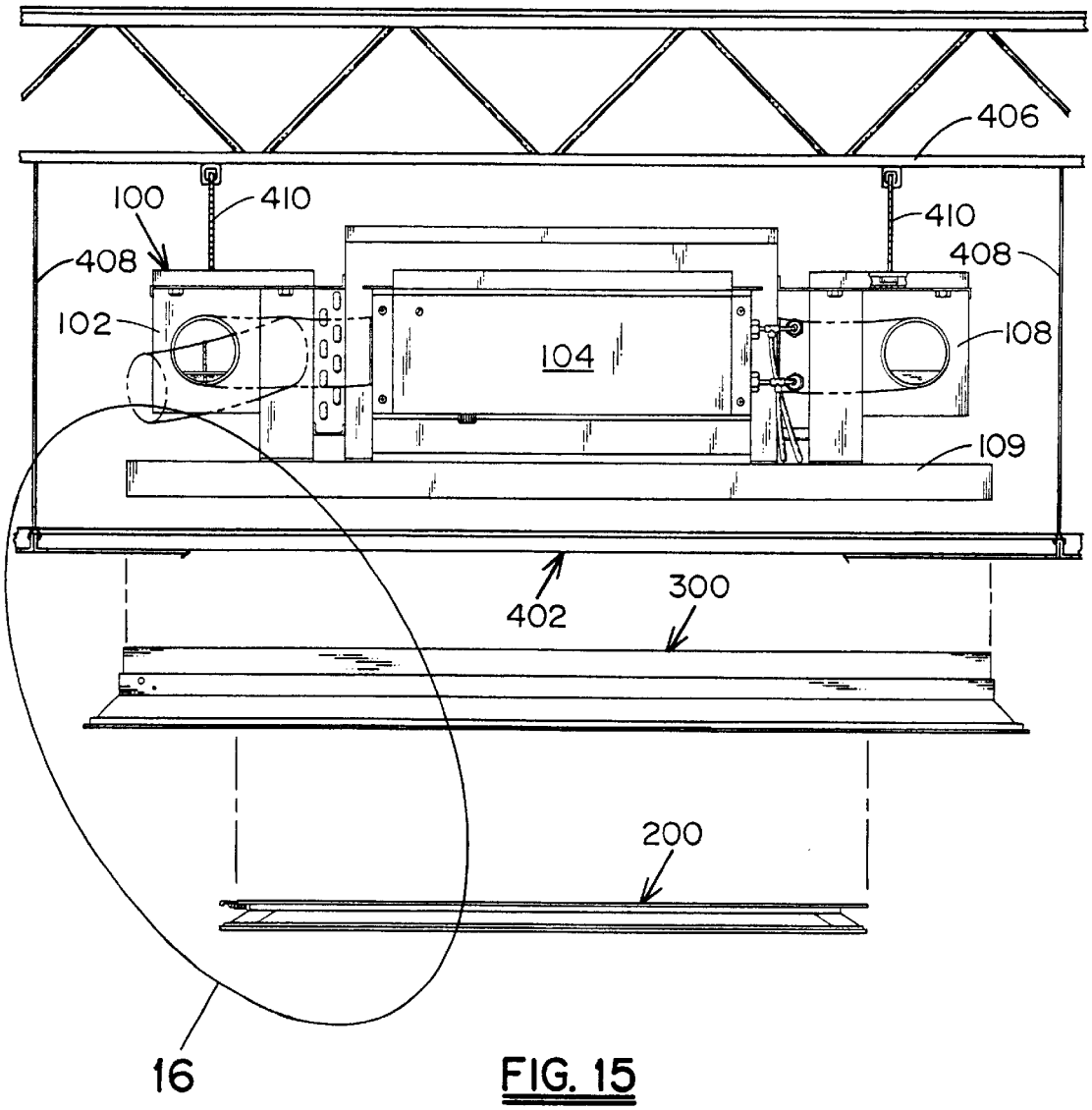
FIG. 15 is an exploded front elevation view of the various subassemblies comprising the present invention.

Referring to FIGS. 3–5, outer diffuser assembly 300 comprises an upper frame member 302 that engages inductor frame 109, a medial frame member 304 securely interconnected to upper frame member 302 via fasteners 306, and an outwardly flared lower frame member 308 extending downwardly from medial frame member 304. A ridge 310 is formed along opposing edges at the interior intersection of medial and lower frame members 304, 308 (see FIG. 5), and clips 216, 218 engage respective ridges 310, thereby interconnecting diffuser frame assembly 200 to outer diffuser assembly 300. When interconnected in this manner, an air flow gap 312 (see FIG. 6) exists between louvers 204–210 and lower frame member 308. A sealing frame 314 is connected to medial frame member 304 via fasteners 316 and positioned directly above frame assembly 200 when its interconnected to outer diffusion assembly 300. Sealing frame member 314 includes a gasket 318 against which diffuser assembly 200 abuts when interconnected to outer diffuser assembly to prevent air from leaking out of system 10.

Figure 18:
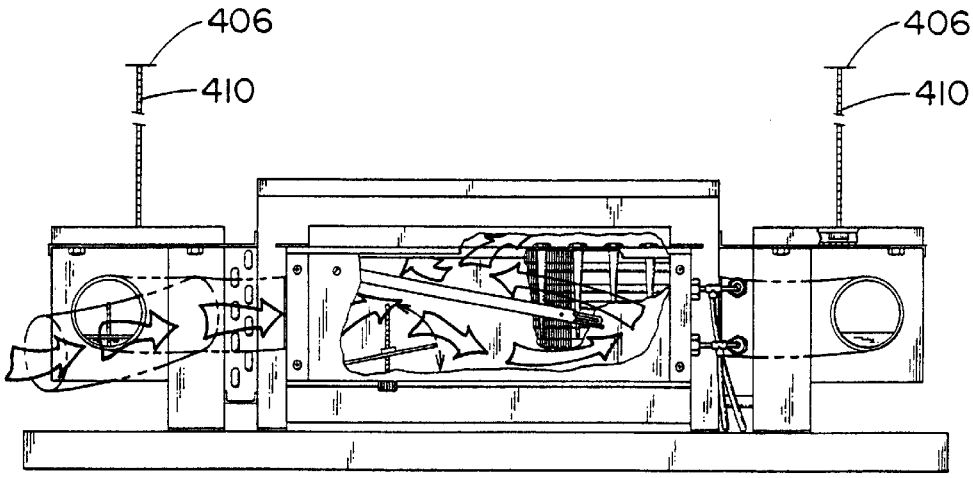
FIG. 18 is a side elevation view of the present invention to illustrate the primary air flow direction.

Outer diffuser assembly 300 is affixed relative to the ceiling of room 12 by an S-clip 400 joining it to a ceiling panel assembly 402. Ceiling panel assembly 402, in turn, is affixed to and suspended from rafter structure 406 via cables 408. With reference to FIG. 18, system 10 is suspended from rafter structure 406 via cables 410. It should be understood that system 10 can be implemented in practically any room environment with the one described herein being for illustrative and explanatory purposes only.

Figure 19:
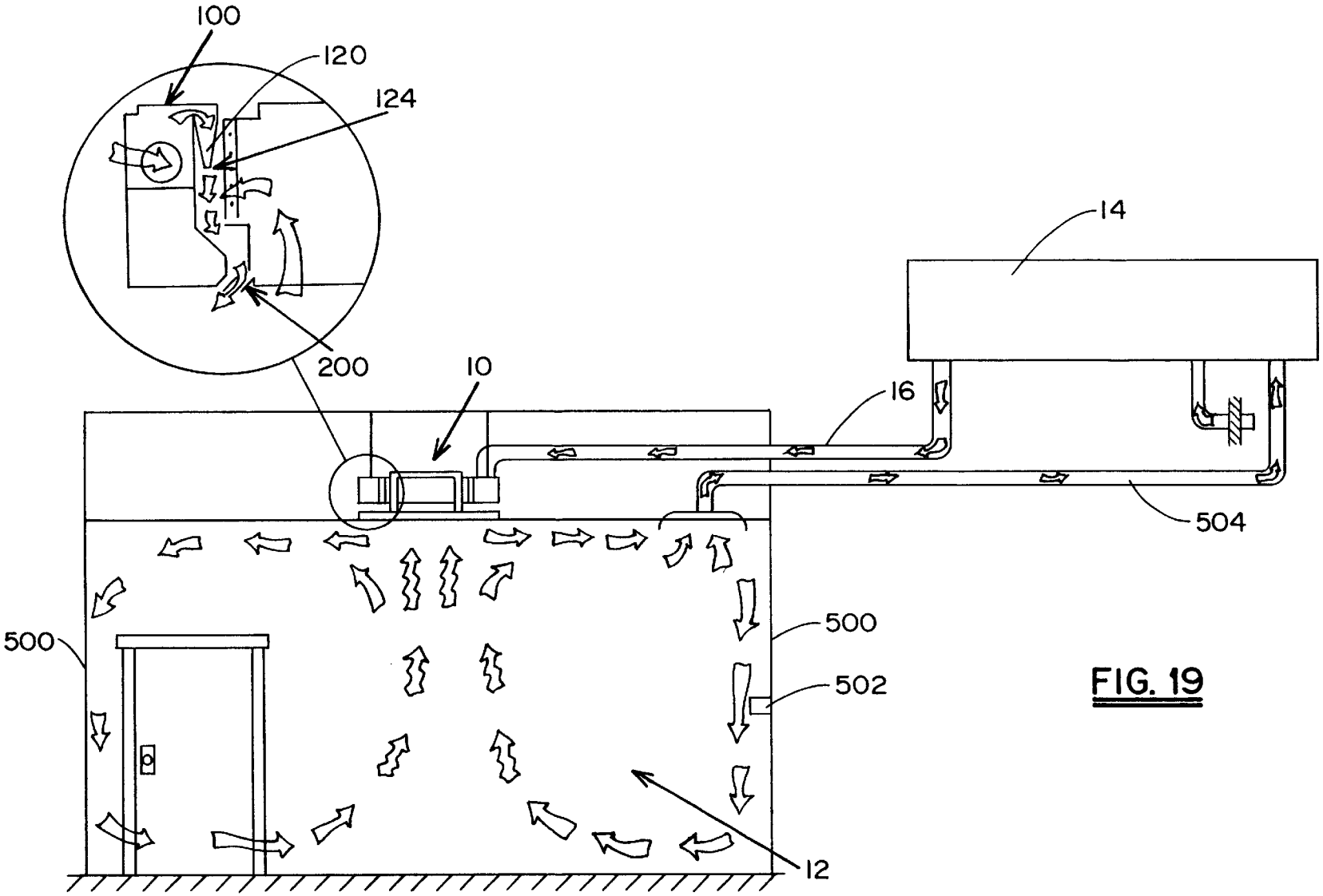
FIG. 19 is a front elevation of the present invention installed in a room and showing the air flow pattern in the room, the primary air flow direction, and the secondary air flow direction.

With reference to FIG. 19, operation of system 10 in a room 12 is illustrated. The flow pattern of the air (primary and secondary) described hereinabove is illustrated with the arrows. The portion of air passing downwardly along a wall 500 is detected by a sensor 502. Sensor 502 can be any kind of conventional air sensor, such as a temperature sensor or humidity sensor, and detects the condition of the passing air. Sensor 502 transmits the sensed air through conduit 504 to primary air source 14 which can then adjust its settings to maintain the primary air supply at predetermined conditions (i.e., at predetermined temperature and/or humidity levels).

Although a preferred embodiment of the present invention has been explained herein, it should be understood that the spirit and scope of the present patent should not be limited thereby, but rather should extend to the bounds defined by the appended claims.

What is claimed is:

1. An air handling system for receiving air from a primary air source and distributing air in a room defining an enclosed space, said air handling system comprising:

a. first, second, third, and fourth inductor units interconnected downstream to and positioned remotely from said primary air source and defining first, second, third, and fourth areas, respectively, wherein said air is induced to flow through said first, second, third, and fourth inductor units and into said first, second, third, and fourth areas, respectively; and b. an air diffusing mechanism positioned adjacent to said first, second, third, and fourth areas for directing said induced air from said first, second, third, and fourth areas in first, second, third, and fourth directions, respectively.

2. The air handling system of claim 1, wherein said first, second, third, and fourth inductor units are interconnected to one another in a rectangular arrangement.

3. The air handling system of claim 2, wherein said rectangular arrangement is square.

4. The air handling system of claim 1, further comprising a Y-shaped coupling unit interconnecting said first and second induction units.

5. The air handling system of claim 4, wherein said Y-shaped coupling unit substantially equally splits the flow of said air received from said primary air source to said first and second induction units.

6. The air handling system of claim 4, wherein said third induction unit is interconnected to said first induction unit, and said fourth induction unit is interconnected to said second induction unit.

7. The air handling system of claim 6, wherein a portion of said air received in said first induction unit flows into said third induction unit, and a portion of said air received by said second induction unit flows into said fourth induction unit.

8. The air handling system of claim 1, wherein said first area is positioned at substantially right angles relative to said second and third areas, and is essentially parallel relative to said fourth area.

9. The air handling system of claim 8, wherein said air diffusing mechanism includes first, second, third, and fourth sets of louvers that direct the flow of air through said first, second, third, and fourth areas, respectively, and into said enclosed space.

10. The air handling system of claim 9, wherein said first, second, third, and fourth sets of louvers are positioned at predetermined angles relative to said first, second, third, and fourth areas, respectively.

11. An air handling system for receiving air from a primary air source and distributing air in a room defining an enclosed space, said air handling system comprising:

a. first, second, third, and fourth inductor units interconnected downstream to said primary air source and defining first, second, third, and fourth areas, respectively, wherein said air is induced to flow through said first, second, third, and fourth inductor units and into said first, second, third, and fourth areas, respectively;

b. an air diffusing mechanism positioned adjacent to said first, second, third, and fourth areas for directing said induced air from said first, second, third, and fourth areas in first, second, third, and fourth directions, respectively; and c. a Y-shaped coupling unit interconnecting said first and second inductor units to one another and to said primary air source.

12. The air handling system of claim 11, wherein said Y-shaped coupling unit substantially equally splits the flow of said air received from said primary air source to said first and second inductor units.

13. The air handling system of claim 12, wherein said third induction unit is interconnected to said first induction unit, and said fourth induction unit is interconnected to said second induction unit.

14. The air handling system of claim 12, wherein a portion of said air received in said first induction unit flows into said third induction unit, and a portion of said air received by said second induction unit flows into said fourth induction unit.

* * * * *